US007867970B2

(12) United States Patent
de Ruijter et al.

(10) Patent No.: US 7,867,970 B2
(45) Date of Patent: Jan. 11, 2011

(54) DETERGENT COMPOSITION COMPRISING LAURIC SOAP

(75) Inventors: Michel Jan de Ruijter, Vlaardingen (NL); Zaida Maria Salazar, Vlaardingen (NL)

(73) Assignee: The Sun Products Corporation, Wilton, CT (US)

( * ) Notice: Subject to any disclaimer, the term of this patent is extended or adjusted under 35 U.S.C. 154(b) by 92 days.

(21) Appl. No.: 10/867,333

(22) Filed: Jun. 14, 2004

(65) Prior Publication Data

US 2004/0254088 A1 Dec. 16, 2004

(30) Foreign Application Priority Data

Jun. 16, 2003 (GB) ..... 0313901.1

(51) Int. Cl.
*C11D 17/00* (2006.01)

(52) U.S. Cl. ..... 510/446; 510/481; 510/488; 510/531

(58) Field of Classification Search ..... 510/444, 510/446, 450, 481
See application file for complete search history.

(56) References Cited

U.S. PATENT DOCUMENTS

| | | | | |
|---|---|---|---|---|
| 4,082,682 | A * | 4/1978 | Inamorato et al. | 510/324 |
| 4,664,839 | A | 5/1987 | Rieck | 252/175 |
| 4,992,193 | A * | 2/1991 | Evans | 510/349 |
| 5,443,751 | A | 8/1995 | Mazzola | 252/174.13 |
| 5,591,705 | A * | 1/1997 | Brinson et al. | 510/276 |
| 5,736,502 | A * | 4/1998 | Wilkinson | 510/444 |
| 5,916,866 | A * | 6/1999 | Davies et al. | 510/441 |
| 6,579,466 | B1 | 6/2003 | David et al. | 252/8.61 |
| 6,608,021 | B1 | 8/2003 | Westfield et al. | |
| 2003/0040457 | A1 * | 2/2003 | Behler et al. | 510/421 |

FOREIGN PATENT DOCUMENTS

| | | | |
|---|---|---|---|
| DE | 4310672 | * | 1/1993 |
| DE | 43 10 672 | | 10/1994 |
| EP | 265 258 | | 4/1988 |
| EP | 0265258 | * | 4/1988 |
| EP | 164 514 | | 6/1989 |
| EP | 0432449 | * | 11/1990 |
| EP | 432 449 | | 6/1991 |
| EP | 384 070 | | 9/1995 |
| GB | 1 429 143 | | 3/1976 |
| GB | 1 470 250 | | 4/1977 |
| GB | 1 473 201 | | 5/1977 |
| GB | 1 473 202 | | 5/1977 |
| GB | 2 123 044 | | 1/1984 |
| RU | 116 299 | | 12/2000 |
| WO | 95/32997 | | 12/1995 |

OTHER PUBLICATIONS

PCT Search Report in a PCT application PCT/EP 2004/006083.
Derwent Abstract of JP 870161953—published Aug. 29, 1987.
GB Search Report in a GB application GB 0313901.1.

* cited by examiner

*Primary Examiner*—Necholus Ogden, Jr.
(74) *Attorney, Agent, or Firm*—Sterne, Kessler, Goldstein & Fox P.L.L.C.

(57) ABSTRACT

The laundry detergent composition of the invention contains a combination of a soap, an anionic surfactant, a nonionic surfactant, optionally a builder system, and optionally other detergent ingredients. The surfactant system comprises from 5 to 85 wt % in which the amount of soap is from 20 to 50 wt %, the amount of anionic is from 10 to 65 wt %, and the amount of nonionic is from 15 to 70 wt %, and wherein from 75 wt % to 100 wt % of the soap is present in the form of a granule which is dry-mixed with the other components, and the soap granule has a concentration of soap of at least 75 wt % based on the weight of the granule.

11 Claims, No Drawings

DETERGENT COMPOSITION COMPRISING LAURIC SOAP

TECHNICAL FIELD

The present invention relates to a granular laundry detergent composition containing a combination of soap granules, anionic and nonionic surfactants giving improved dissolution across a range of water hardnesses.

BACKGROUND OF THE INVENTION

Soap is a common ingredient of detergent powder compositions. It may be included as a detergent active, a builder or a foam suppresser. It may be added to a slurry which is subsequently spray-dried, or in-situ neutralised from the fatty acid and/or dry-mixed with other particulate ingredients, including composite particles which are themselves the product of a spray-drying process or other granulation process.

To formulate most flexibly, it is more advantageous to dry-mix soap with the rest of the ingredients, without intermediate processing. When supplied as a raw material for incorporating in such compositions, soap is often in the form of a fine dusty powder. As well as being difficult to handle, such powders have a tendency to cause respiratory tract irritation in those working with them. It is known to incorporate extruded or flaked soap "noodles" in detergent compositions, which have a "particle" size much greater than found in the aforementioned dusty powders. However, this is often done purely to create a visual effect, for example when such noodles are deliberately coloured as indictia of certain benefits. The noodle format is also not a very cost-effective means of supplying the soap, especially when formulating dry mixed powders.

Laundry detergent compositions have for many years contained anionic surfactants together with nonionic surfactants.

It is well known that many anionic surfactants form calcium precipitates, that reduces their effectiveness and that may adhere to clothes. Especially much used anionic surfactants like sodium linear alkyl benzene sulphonate (NaLAS), and sodium primary alcohol sulphate (NaPAS). Similarly it is know that soaps are also sensitive to calcium precipitation and that it in fact soap precipitates very strongly. It is therefore common to include builders in laundry formulations.

Common builders are phosphates and zeolites. However, phosphates are not favoured because possible eutrification of waterways. Zeolites are insoluble and might leave residues to clothes.

Mixtures of anionic and non-ionic surfactants are less prone to form calcium precipitates, and these mixtures are applied in many European Countries. However, common nonionic surfactants are more liquid-like and are consequently more difficult to process into solid, non-sticky laundry products.

It has now surprisingly been found that although the soap and the anionics precipitate very strongly on their own, and they also precipitate when the anionic and the soap are combined together. When soaps, anionics and nonionics are used in the specific levels and in the specific format detailed in the invention, for example the addition of the majority of the soap granules to the rest of the detergent ingredients at the post dosing stage as a dry-mix soap granule and in the form of highly concentrated granules, this results in the tendency to precipitate in hard water being lower than for formulations containing only the anionic surfactant, only the soap or the anionic and soap in combination. This advantageously enables the reduction of nonionic and builder requirements in such a composition for the prevention of precipitates.

DEFINITION OF THE INVENTION

According to a first aspect of the invention, there is provided a laundry detergent composition comprising (a) from 5 to 85 wt % of a surfactant system comprising;
(i) from 20 to 50 wt % of a soap,
(ii) from 10 to 65 wt % of an anionic surfactant,
(iii) from 15 to 70 wt % of a nonionic surfactant, (b) optionally, from 0 to 15 wt % of a builder system, and;

(c) optionally, other detergent ingredients to 100 wt %, wherein from 75 wt % to 100 wt % of the soap is present in the form of a granule which is dry-mixed with the other components, and the soap granule has a concentration of soap of at least 75 wt % based on the weight of the granule.

According to a second aspect of the invention, there is provided the use of a laundry detergent composition as claimed in any preceding claim to improve the dissolution of such a composition in hard water.

According to a third aspect of the invention, there is provided a process for the preparation of a laundry detergent as claimed in any preceding claim.

DETAILED DESCRIPTION OF THE INVENTION

The detergent composition of the invention contains a combination of a soap, an anionic surfactant, a nonionic surfactant, optionally a builder system, and optionally other detergent ingredients. Wherein a set amount of the soap is present in the form of granules which are dry-mixed with the other components, and the soap granule has a defined concentration of soap.

Detergent compositions according to the invention show improved dissolution properties across a range of water hardnesses.

The Soap (i)

According to the invention from 5 to 85 wt %, preferably 7 to 60 wt %, more preferably 10 to 35 wt % of the surfactant system comprises from 20 to 50 wt % of a soap. Preferably the surfactant system comprises from 30 to 40 wt % of a soap.

In a preferred embodiment of the invention from 80 wt % to 100 wt %, preferably from 85 to 95 wt % of the soap is present in the form of granules.

The laundry detergent compositions of the current invention comprise a soap granule which has a concentration of soap of at least 75 wt % based on the weight of the composition. In a preferred embodiment of the invention the soap granule has a concentration of soap of from 80 to 95 wt %, preferably from 85 to 90 wt %. Preferably the soap granules contain more than 90 wt % soap, less than 10 wt % moisture and less than 1 wt % sodium hydroxide.

Useful soap compounds include the alkali metal soaps such as the sodium, potassium, ammonium and substituted ammonium (for example monoethanolamine) salts or any combinations of this, of higher fatty acids containing from about 8 to 24 carbon atoms.

In a preferred embodiment of the invention he fatty acid soap has a carbon chain length of from $C_{10}$ to $C_{22}$, more preferably $C_{12}$ to $C_{20}$.

Suitable fatty acids can be obtained from natural sources such as plant or animal esters e.g. palm oil, coconut oil, babassu oil, soybean oil, caster oil, rape seed oil, sunflower oil, cottonseed oil, tallow, fish oils, grease lard and mixtures thereof. Also fatty acids can be produced by synthetic means such as the oxidation of petroleum, or hydrogenation of carbon monoxide by the Fischer Tropsch process. Resin acids are suitable such as rosin and those resin acids in tall oil. Naphthenic acids are also suitable. Sodium and potassium soaps can be made by direct saponification of the fats and oils or by the neutralisation of the free fatty acids which are prepared in a separate manufacturing process. Particularly useful are the sodium and potassium salts and the mixtures of fatty acids derived from coconut oil and tallow, i.e. sodium tallow soap, sodium coconut soap, potassium tallow soap, potassium coconut soap. In a preferred embodiment of the invention the soap is a fatty acid soap. In a further preferred embodiment of the invention the fatty acid soap is a lauric soap. For example Prifac 5908 a fatty acid from Uniqema which was neutralised with caustic soda. This soap is an example of a fully hardened or saturated lauric soap, which in general is based on coconut or palm kernel oil.

In preferred embodiment of the invention the soap is saturated. Also hardened or unsaturated lauric soaps based on coconut or palm kernel oil can be used. These soaps consist mainly of laurate with 12 carbon atoms, and myristate with 14 carbon atoms. Also mixtures of coconut or palm kernel oil and for example palm oil, olive oil, or tallow can be used. In this case more palmitate with 16 carbon atoms, stearate with 18 carbon atoms, palmitoleate with 16 carbon atoms and with one double bond, oleate with 18 carbon atoms and with one double bond and/or linoleate with 18 carbon atoms and with two double bonds are present.

Preferably the soap does not stand out from the rest of the ingredients. It therefore needs to be whitish, and more or less round namely with an aspect ratio of less than 2. This ensures that the laundry powder in its final format is free-flowing and containing a soap granule means that it is congruent with the rest of the composition.

In a preferred embodiment he soap has a particle size of from 400 to 1400 μm, preferably 500 to 1200 μm.

In a preferred embodiment the soap granule has a bulk density of from 400 to 650 g/liter, and the bulk density of the fully formulated powders are from 400 to 900 g/liter.

Fabric washing powders containing major quantities of soap are favoured by some consumers because of good detergency, and the tendency to leave clothes feeling softer than those washed with powders based on synthetic detergent-active compounds. Soap also has environmental advantages in that it is fully biodegradable, and is a natural material derived from renewable raw materials.

Saturated sodium soaps have high Krafft temperatures and consequently dissolve poorly at low temperatures, which are applied by some consumers. It is well known that certain mixtures of saturated and unsaturated soaps have much lower Krafft temperatures. However, unsaturated soaps are less stable upon storage, and tend to be malodorous. The soap mixture used in the granules therefore needs to be a careful balance between dissolution properties and stability properties. The stability of the soap is enhanced when it is concentrated in granules; compared to soap that is incorporated at low concentration into composite granules.

The soap may be used in combination with a suitable antioxidant for example ethylenediamine tetraacetic acid and/or ethane-1-hydroxy-1,1-diphosphonic acid. Also preservatives may be present to prevent degradation of the soap with can result in malodour or discolouration for example sodium hydroxyethlidene disphosphonic acid.

In a preferred embodiment of the invention the soap granule is post dosed.

The Anionic Surfactant (ii)

Anionic surfactants are well known to those skilled in the art. Examples include alkylbenzene sulphonates, particularly linear alkylbenzene sulphonates having an alkyl chain length of $C_8$-$C_{15}$; primary and secondary alkylsulphates, particularly $C_8$-$C_{20}$ primary alkyl sulphates; alkyl ether sulphates; olefin sulphonates; alkyl xylene sulphonates; dialkyl sulphosuccinates; and fatty acid ester sulphonates. Sodium salts are generally preferred.

According to a preferred embodiment of the invention, the granular laundry detergent composition comprises an anionic surfactant which is a sulphonate anionic surfactant.

According to an especially preferred embodiment, the sulphonate anionic surfactant comprises linear alkylbenzene sulphonate (LAS).

In a preferred embodiment the anionic surfactant is present in an amount of from 15 to 50 wt %.

In a preferred embodiment the weight ratio of the anionic surfactant to soap is from 0.5:1 to 5:1, preferably 1:1 to 2:1.

The Nonionic Surfactant (iii)

In a preferred embodiment the nonionic surfactant is present in an amount of from 20 to 60 wt %.

Nonionic surfactants that may be used include the primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Examples of suitable nonionics include Neodol 25 5E from Shell, which is a C12 to C15 poly (1 to 6) ethoxylate with an average degree of ethoxylation of 5. Also suitable is Lutensol A7 a C13 to C15 ethoxylate from BASF, with an average degree of ethoxylation of 7.

HLB values can be calculated according to the method given in Griffin, J. Soc. Cosmetic Chemists, 5 (1954) 249-256.

For example, the HLB of a polyethoxylated primary alcohol nonionic surfactant can be calculated according to the following formula:

$$HLB = \frac{MW(EO)}{MW(Tot) \times 5} \times 100$$

where,

MW(EO)=the molecular weight of the hydrophilic (ethoxy) part

MW(Tot)=the molecular weight of the whole surfactant molecule

In a preferred embodiment the nonionic surfactant is an alkoxylated alcohol nonionic surfactant.

In an especially preferred embodiment the nonionic surfactant is an ethoxylated alcohol nonionic surfactant of the general formula I $$R—(—O—CH_2—CH_2)_n—OH \quad (I)$$

wherein R is a hydrocarbyl chain having from 8 to 20, preferably 10 to 18, more preferably 12 to 16, most preferably 15 to 15 carbon atoms, and the average degree of ethoxylation n is from 2 to 20, preferably 4 to 15, more preferably 6 to 10.

In a preferred embodiment the weight ratio of the nonionic surfactant to soap is within the range of from 0.5:1 to 5:1, preferably 0.75:1 to 4:1, even more preferably 0.75:1 to 2:1, most preferably 0.75:1 to 1.5:1, it may also be 0.75:1 to 1:1.

The Optional Builder (b)

The compositions of the invention may contain a detergency builder. Preferably the builder is present in an amount of from 0 to 15 wt % based on the weight of the total composition. Alternatively the compositions may be essentially free of detergency builder.

The builder may be selected from strong builders such as phosphate builders, aluminosilicate builders and mixtures thereof. One or more weak builders such as calcite/carbonate, citrate or polymer builders may be additionally or alternatively present.

The phosphate builder (if present) may for example be selected from alkali metal, preferably sodium, pyrophosphate, orthophosphate and tripolyphosphate, and mixtures thereof.

The aluminosilicate (if present) may be, for example, selected from one or more crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst).

The alkali metal aluminosilicate may be either crystalline or amorphous or mixtures thereof, having the general formula: $0.8\text{-}1.5Na_2O.Al_2O_3.0.8\text{-}6\ SiO_2$.

These materials contain some bound water and are required to have a calcium ion exchange capacity of at least 50 mg CaO/g. The preferred sodium aluminosilicates contain 1.5-3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Suitable inorganic salts include alkaline agents such as alkali metal, preferably sodium, carbonates, sulphates, silicates, metasilicates as independent salts or as double salts. The inorganic salt may be selected from the group consisting of sodium carbonate, sodium sulphate, burkeite and mixtures thereof.

The Other Optional Detergent Ingredients (c)

As well as the surfactants and builders discussed above, the compositions may optionally contain other active ingredients to enhance performance and properties.

Additional detergent-active compounds (surfactants) may be chosen from soap and non-soap anionic, cationic, non-ionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch.

Cationic surfactants that may be used include quaternary ammonium salts of the general formula $R_1R_2R_3R_4N^+X^-$ wherein the R groups are long or short hydrocarbyl chains, typically alkyl, hydroxyalkyl or ethoxylated alkyl groups, and X is a solubilising anion (for example, compounds in which $R_1$ is a $C_8$-$C_{22}$ alkyl group, preferably a $C_8$-$C_{10}$ or $C_{12}$-$C_{14}$ alkyl group, $R_2$ is a methyl group, and $R_3$ and $R_4$, which may be the same or different, are methyl or hydroxyethyl groups); and cationic esters (for example, choline esters).

Amphoteric surfactants and/or zwitterionic surfactants may also be present.

Preferred amphoteric surfactants are amine oxides. These are materials of the general formula $$R_1R_2R_3N\rightarrow O$$

wherein $R_1$ is typically a $C_8$-$C_{18}$ alkyl group, for example, $C_{12}$-$C_{14}$ alkyl, and $R_2$ and $R_3$, which may be the same or different, are $C_1$-$C_3$ alkyl or hydroxyalkyl groups, for example, methyl groups. The most preferred amine oxide is coco dimethylamine oxide.

Preferred zwitterionic surfactants are betaines, and especially amidobetaines.

Preferred betaines are $C_8$-$C_{18}$ alkyl amidoalkylbetaines, for example, coco amidopropyl betaine (CAPB).

The detergent compositions of the invention may comprise one or more optional ingredients selected from, peroxyacid and persalt bleaches, bleach activators, sequestrants, cellulose ethers and esters, cellulosic polymers, other antiredeposition agents, sodium sulphate, sodium silicate, sodium chloride, calcium chloride, sodium bicarbonate, other inorganic salts, fluorescers, photobleaches, polyvinyl pyrrolidone, other dye transfer inhibiting polymers, foam controllers, foam boosters, acrylic and acrylic/maleic polymers, proteases, lipases, cellulases, amylases, other detergent enzymes, citric acid, soil release polymers, fabric conditioning compounds, coloured speckles, and perfume. This list is not intended to be exhaustive.

Yet other materials that may be present in detergent compositions of the invention lather control agents or lather boosters as appropriate; dyes and decoupling polymers.

Suitable lather boosters for use in the present invention include cocamidopropyl betaine (CAPB), cocomonoethanolamide (CMEA) and amine oxides.

Preferred amine oxides are of the general form:—

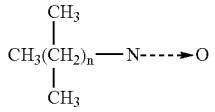

where, n is from 7 to 17.

A suitable amine oxide is Admox (Trademark) 12, supplied by Albemarle.

Bleaches

Detergent compositions according to the invention may suitably contain a bleach system. The bleach system is preferably based on peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate. Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED). Also of interest are peroxybenzoic acid precursors, in particular, N,N,N-trimethylammonium toluoyloxy benzene sulphonate.

A bleach stabiliser (heavy metal sequestrant) may also be present. Suitable bleach stabilisers include ethylenediamine tetraacetate (EDTA) and the polyphosphonates such as Dequest (Trade Mark), EDTMP.

Enzymes

The detergent compositions may also contain one or more enzymes. Suitable enzymes include the proteases, amylases, cellulases, oxidases, peroxidases and lipases usable for incorporation in detergent compositions.

In particulate detergent compositions, detergency enzymes are commonly employed in granular form in amounts of from about 0.1 to about 3.0 wt %. However, any suitable physical form of enzyme may be used in any effective amount.

Other

Antiredeposition agents, for example cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokolan (Trade Mark) HP22. Especially preferred soil release polymers are the sulphonated non-end-capped polyesters described and claimed in WO 95 32997A (Rhodia Chimie).

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %, based on the weight of the total composition.

Form of the Composition

The compositions of the invention may be of any suitable physical form, for example, particulates (powders, granules, tablets), liquids, pastes, gels or bars.

Preferably the detergent composition is in granular form.

The composition can be formulated for use as hand wash or machine wash detergents.

Preparation of the Compositions

Soap can be made in several ways and is well known. For example it can be made by neutralising fatty acid with caustic. The excess water is then dried by for example spray-drying or flash-drying. Most processes result in dusty powders or flakes of neutralised soap. To transform the powder to granules with appropriate particle size and form, an additional step is required. This could be granulation with or without a binder in high shear or low shear granulators. It could also be done by extrusion, complemented by rounding off the particles. Flakes could be milled and sieved, or also extruded and rounded. Soap granules that are made on a VRV flash-drier are suitable. This equipment combines drying and granulation in one step. Commercial soap granules made on VRV equipment is available from Uniqema under the name Prisavon.

The compositions of the invention may be prepared by any suitable process.

Suitable processes for the production of compositions in powder form include:

(1) drum drying of principal ingredients, optionally followed by granulation or postdosing of additional ingredients;

Dry mixing is a common process in powdery laundry products. Generally, several ingredients in granule or particulate form, including separately prepared granules, base powders and otherwise encapsulated ingredients are added to a low shear mixer (e.g. rotating drum mixer), where the ingredients are well mixed. Some ingredients may be sprayed on at this stage (e.g. perfumes). The mixture is then ready for packaging (powders) or tabletting (tablets). Other possible alternative is granulating the soap with some other ingredients in an intermediate step before dry-mixing, but this is not preferred. This last method is common practice (fatty acid is commonly granulated with other surfactants, builder etc. in a base powder, and is in-situ neutralized with caustic soda (or sodium carbonate to soap), but this reduces the flexibility to formulate.

(2) non-tower granulation of all ingredients in a high-speed mixer/granulator, for example, a Fukae (Trade Mark) FS series mixer, preferably with at least one surfactant in paste form so that the water in the surfactant paste can act as a binder;

(3) non-tower granulation in a high speed/moderate speed granulator combination, thin film flash drier/evaporator or fluid bed granulator.

Powders of low to moderate bulk density may be prepared by spray-drying a slurry, and optionally postdosing (dry-mixing) further ingredients. "Concentrated" or "compact" powders may be prepared by mixing and granulating processes, for example, using a high-speed mixer/granulator, or other non-tower processes.

Tablets may be prepared by compacting powders, especially "concentrated" powders.

Liquid detergent compositions may be prepared by admixing the essential and optional ingredients in any desired order to provide compositions containing the ingredients in the requisite concentrations.

The choice of processing route may be in part dictated by the stability or heat-sensitivity of the surfactants involved, and the form in which they are available.

In all cases, ingredients such as enzymes, bleach ingredients, sequestrants, polymers and perfumes may be added separately.

In a preferred embodiment of the invention there is provided the use of a laundry detergent composition as claimed in any preceding claim, wherein the water hardness is from 10 to 40 degrees of French hardness, preferably 16 to 32 degrees of French hardness.

EXAMPLES

The invention will now be further illustrated by the following, non-limiting examples, in which parts and percentages are by weight.

In the table below, the turbidity of several surfactant mixtures was measured, at different water hardnesses. The soap was a fully saturated lauric soap granule based on Prifac 5808 from Uniqema, LAS was the anionic surfactant and Neodol 23 5E from Shell, namely a C12 to C15 poly (1 to 6) ethoxylate with an average degree of ethoxylation of 5, was the nonionic surfactant. Turbidity is a measure of how many precipitates are formed by the surfactant mixture when calcium ions are present. The turbidity should be lower than 0.1.

The turbidity of a surfactant solution is measured by the absorption of light when passing through the solution. Here the absorption was measured with a spectrophotometer (Labsystem Multiscanb MS) at 1 wavelength (540 nm). The equipment was calibrated with millipore water (turbidity=0) and no light transmittance (turbidity=1). The solutions were made by dissolving the surfactants in millipore water. The hardness was provided by CaCl.2H2O and MgCl.6H2O, such that the ratio of calcium to magnesium ions was 4:1. In all cases, 1.008 g/l surfactant was present. The solutions were well stirred. The experiments were carried out at room temperature, and the final values for turbidity are an average of 4 repeats.

As can be seen, formulations that fall within the limits indicated according to the invention, examples 1 to 7 show little turbidity. Formulations that fall outside the invention, comparative examples A to D, especially those that contain more than more than 50 wt % total anionic show high turbidity.

| | Surfactant Composition | | | Turbidity | | |
|---|---|---|---|---|---|---|
| Example | Soap | LAS | nonionic | 16 FH | 32 FH | 40 FH |
| A | 0.50 | 0.50 | 0 | 0.11 | 0.23 | 0.29 |
| B | 0.25 | 0.75 | 0 | 0.39 | 0.53 | 0.55 |
| C | 0.17 | 0.67 | 0.17 | 0.04 | 0.17 | 0.26 |
| D | 0.67 | 0.17 | 0.17 | 0.13 | 0.14 | 0.13 |
| 1 | 0.33 | 0.33 | 0.33 | 0.04 | 0.05 | 0.05 |
| 2 | 0.25 | 0.50 | 0.25 | 0.04 | 0.05 | 0.05 |
| 3 | 0.25 | 0.25 | 0.50 | 0.05 | 0.05 | 0.05 |
| 4 | 0.50 | 0.25 | 0.25 | 0.07 | 0.06 | 0.07 |
| 5 | 0.33 | 0.17 | 0.50 | 0.09 | 0.08 | 0.05 |
| 6 | 0.33 | 0.50 | 0.17 | 0.09 | 0.09 | 0.06 |
| 7 | 0.25 | 0.38 | 0.38 | 0.08 | 0.07 | 0.05 |

The invention claimed is:

1. A laundry detergent composition comprising:

(a) from 5 to 85 wt % of a surfactant system comprising:

(i) from 20 to 50 wt % of a lauric soap, (ii) from 10 to 65 wt % of an anionic surfactant, (iii) from 15 to 70 wt % of a nonionic surfactant;

(b) maximum 15 wt % of a builder system; and (c) optionally, other detergent ingredients to 100 wt %;

wherein the weight ratio of the nonionic surfactant to soap is within the range of from 0.75:1 to 2:1, wherein the weight ratio of the anionic surfactant to soap is from 1:1 to 2:1, wherein the turbidity of the surfactant system is less than 0.1; and wherein from 75 wt % to 100 wt % of the soap is present in the form of a granule having a particle size of between 400 to 1,400 pm and a bulk density of from 400 to 650 g/liter which is dry-mixed with the other components, and wherein the soap granule has a concentration of soap of at least 90 wt % based on the weight of the granule.

2. A laundry detergent composition as claimed in claim 1, wherein the anionic surfactant is a sulphonate anionic surfactant.

3. A laundry detergent composition as claimed in claim 2, wherein the sulphonate anionic surfactant comprises linear alkyl benzene sulphonate.

4. A laundry detergent composition as claimed in claim 1, wherein the nonionic surfactant is an alkoxylated alcohol nonionic surfactant.

5. A laundry detergent composition as claimed in claim 1, wherein the nonionic surfactant is an ethoxylated alcohol nonionic surfactant of the general formula I:

$$R—(—O—CH_2—CH_2)_n—OH \quad (I)$$

wherein R is a hydrocarbyl chain having from 8 to 20 carbon atoms, and the average degree of ethoxylation n is from 2 to 20.

6. A laundry detergent composition as claimed in claim 5, wherein the ethoxylated alcohol nonionic surfactant has a hydrocarbyl chain length of from $C_{12}$ to $C_{18}$.

7. A laundry composition as claimed in claim 1, wherein the weight ratio of the nonionic surfactant to soap is within the range of from 0.75:1 to 1.5:1.

8. A laundry detergent composition as claimed in claim 1, wherein from 80 wt % to 100 wt %, preferably from 85 to 95 wt % of the soap is present in the form of granules.

9. A method of improving the dissolution of a laundry detergent composition in hard water, the method comprising adding to the laundry machine the composition of claim 1.

10. A process for the preparation of a laundry detergent as claimed in claim 1.

11. The method as claimed in claim 9, wherein the water hardness is from 10 to 40 degrees of French hardness, preferably 16 to 32 degrees of French hardness.

* * * * *